US009192205B2

(12) United States Patent
McDowell

(10) Patent No.: US 9,192,205 B2
(45) Date of Patent: Nov. 24, 2015

(54) BALL SLIDE SANDAL

(75) Inventor: Sean M. McDowell, Andover, MA (US)

(73) Assignee: Converse Inc., Boston, MA (US)

( * ) Notice: Subject to any disclaimer, the term of this patent is extended or adjusted under 35 U.S.C. 154(b) by 100 days.

(21) Appl. No.: 13/419,018

(22) Filed: Mar. 13, 2012

(65) Prior Publication Data

US 2013/0239435 A1 Sep. 19, 2013

(51) Int. Cl.

| | |
|---|---|
| ***A43B 5/08*** | (2006.01) |
| ***A43B 3/10*** | (2006.01) |
| ***A43B 7/08*** | (2006.01) |
| ***A43B 7/14*** | (2006.01) |

(52) U.S. Cl.

CPC . *A43B 3/108* (2013.01); *A43B 5/08* (2013.01); *A43B 7/087* (2013.01); *A43B 7/141* (2013.01)

(58) Field of Classification Search

CPC ..... A43B 3/108; A43B 7/141; A43B 7/087; A43B 7/085; A43B 5/08; A43B 3/10; A43B 13/223; A43B 7/149; A43B 13/203

USPC .... 36/38, 39, 32 R, 25 R, 3 R, 7.1 R, 7.4, 15, 36/43, 141, 11.5, 3 B, 29

See application file for complete search history.

(56) References Cited

U.S. PATENT DOCUMENTS

| | | | | | |
|---|---|---|---|---|---|
| 2,090,881 | A | * | 8/1937 | Wilson | 36/29 |
| 3,722,113 | A | * | 3/1973 | Birkenstock | 36/11.5 |
| 3,757,774 | A | | 9/1973 | Hatuno | |
| 4,112,599 | A | * | 9/1978 | Krippelz | 36/11.5 |
| D281,735 | S | * | 12/1985 | Seltzer | D2/916 |
| 4,831,749 | A | * | 5/1989 | Tsai | 36/3 B |
| D315,634 | S | * | 3/1991 | Yung-Mao | D2/954 |
| 6,061,928 | A | * | 5/2000 | Nichols | 36/28 |
| 2002/0184791 | A1 | * | 12/2002 | Ko | 36/8.1 |
| 2003/0106240 | A1 | * | 6/2003 | Wang et al. | 36/3 B |
| 2005/0132607 | A1 | * | 6/2005 | Dojan et al. | 36/29 |
| 2007/0245592 | A1 | * | 10/2007 | Yamaguchi et al. | 36/11.5 |
| 2009/0056171 | A1 | * | 3/2009 | Lin | 36/3 B |

FOREIGN PATENT DOCUMENTS

| | | |
|---|---|---|
| EP | 383685 | 8/1990 |
| GB | 2303780 | 3/1997 |

OTHER PUBLICATIONS

Notification of Transmittal of the International Search Report and the Written Opinio of the International Searching Authority, or the Declaration in PCT/US13/30193 mailed May 23, 2013, 58 pages.

* cited by examiner

*Primary Examiner* — Jila M Mohandesi
*Assistant Examiner* — Katharine Gracz
(74) *Attorney, Agent, or Firm* — Shook, Hardy & Bacon L.L.P.

(57) ABSTRACT

The present invention is directed to a sandal with a sole. The sole has an upper surface and an opposite lower surface. The upper surface is formed from objects, such as hemispheres and/or spheres that each has a curved surface forming at least a portion of the upper surface. The lower surface is also formed from objects, which may be the same as those that form the upper surface. Additionally, the sole is formed with voids extending from the upper surface to the lower surface. The voids are defined, in part, by the objects near the upper surface and the objects near the lower surface.

16 Claims, 5 Drawing Sheets

BALL SLIDE SANDAL

BACKGROUND

Footwear, such as sandals, provide a sole that protects and separates a user's foot from a ground surface when in an-as-worn position. The sole may protect a user's foot from rough terrain, slippery conditions, and un-hygienic environments. For example, a sandal may be worn as a shower sandal in a community shower, which may have slippery and unsanitary surfaces that a user whishes to avoid directly contacting. Sandals may also be used in a variety of other environments, such as the beach, to protect the user from hot sand and other surfaces.

SUMMARY

Embodiments of the present invention relate to a sandal with a sole having rounded objects forming an upper surface in contact with a foot and with rounded objects also forming a lower surface in contact with the ground. Between the rounded objects voids are formed. The voids may allow for circulation of air, dispersion of water and debris, and a reduction in weight. The rounded objects may be spheres that are either directly coupled or indirectly coupled with one another to form the sole of the sandal.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE SEVERAL VIEWS OF THE DRAWINGS

Illustrative embodiments of the present invention are described in detail below with reference to the attached drawing figures, which are incorporated by reference herein and wherein.

DETAILED DESCRIPTION

Figure 1:
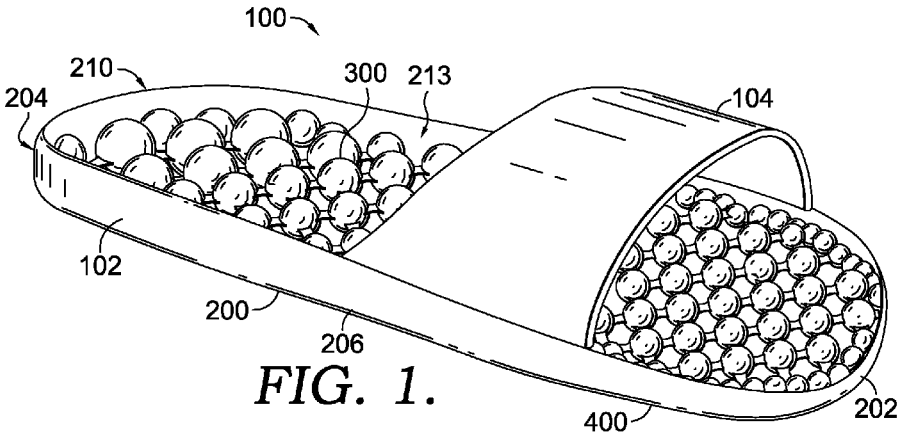
FIG. 1 depicts a perspective view of an exemplary sandal, in accordance with aspects of the present invention.

The subject matter of embodiments of the present invention is described with specificity herein to meet statutory requirements. However, the description itself is not intended to limit the scope of this patent. Rather, the inventors have contemplated that the claimed subject matter might also be embodied in other ways, to include different elements or combinations of elements similar to the ones described in this document, in conjunction with other present or future technologies.

Embodiments of the present invention relate to a sandal with a sole having rounded objects forming an upper surface in contact with a foot and with rounded objects also forming a lower surface in contact with the ground. Between the rounded objects voids are formed. The voids may allow for circulation of air, dispersion of water and debris, and a reduction in weight. The rounded objects may be spheres that are either directly coupled or indirectly coupled with one another to form the sole of the sandal.

Accordingly, in one aspect, the present invention provides a sandal with a sole. The sole has an upper surface for contacting a foot when in an as-worn position, an opposite lower surface for contacting the ground when in an as-worn position. The upper surface is formed from hemispheres that each has a curved surface forming at least a portion of the upper surface. The lower surface is also formed from hemispheres that each has a curved surface. Additionally, the sole is formed with voids extending from the upper surface to the lower surface. The voids are defined, in part, by the hemispheres forming the upper surface and the hemispheres forming the lower surface.

In another aspect, the present invention provides a sandal with a sole. The sole is formed with a perimeter element that extends around a perimeter of the sole forming an interior volume. The sole is also formed with tangentially connected spheres. The spheres form an upper surface and a lower surface of the sole within the interior volume. The upper surface is a surface substantially occupied by a bottom of a foot when in an in-worn position and the lower surface is a surface substantially serving as a traction surface for the sole. The sole is also formed with voids extending through the sole from the upper surface to the bottom lower surface. The voids are located within the interior volume and between the spheres that are tangentially connected/coupled.

A third aspect of the present invention provides a sandal. The sandal is formed with a molded sole having an upper surface and a lower surface, a toe end and an opposite heel end, and having opposite medial and lateral sides extending between the toe end and the heel end. The sole is also formed with spheres arranged to form the upper surface and the lower surface of the sole. Each of the spheres has an upper portion forming a rounded foot contact area; a lower portion forming a rounded traction area; and a mid-band portion extending between the upper portion and the lower portion, the mid-band portion providing a location of coupling between one or more spheres of the plurality of spheres. The sole also includes voids that create an opening through the sole that extends along an upper portion, a mid-band portion, and a lower portion of one or more spheres. The spheres include a first sphere having a first diameter and a second sphere having a different diameter. The first sphere is positioned near the toe end and the second sphere is positioned near the heel end.

Having briefly described an overview of embodiments of the present invention, a more detailed description follows.

FIG. 1 depicts a perspective view of an exemplary sandal 100, in accordance with aspects of the present invention. The sandal 100 is comprised of a sole 102 having an upper surface 300 and a lower surface 400. Additionally, the sole 102 is comprised of a perimeter 200 that forms a perimeter of the sole 102.

The sole 102, in general, has a toe end portion, a heel end portion, a medial side portion, and a lateral side portion. Each of the relative portions of the sole 102 corresponds to a perimeter location. For example, the perimeter 200 is defined by a perimeter element 212 having a toe end 202 that wraps around clockwise on exemplary FIG. 1 to a medial side 206. The perimeter 200 continues around the sole 102 in a clockwise manner to a heel end 204 and then to a lateral side 208. It is understood that a medial side and a lateral side are relative terms depending on if a right-foot sandal or a left-foot sandal are discussed. However, as is conventional with footwear, the sandal 100 is comprised of a customary toe end, an opposite heel end, a medial side, and an opposite lateral side.

The sole 102 is comprised of an upper surface 300 and a lower surface 400. The upper surface 300 provides a foot-contacting surface when in an as-worn orientation. For example, when a user of the sandal 100 wears the sandal 100, the wearer's plantar surface (i.e., bottom of the foot) is in contact with the upper surface 300. Similarly, when in an as-worn orientation, the lower surface 400 is traditionally a ground-contacting surface, such as a typical outsole of a conventional athletic shoe.

As will be discussed in more detail hereinafter, the upper surface 300 and the lower surface 400 are formed from a plurality of rounded surfaces, such as hemispheres, in an exemplary aspect. Further, it is contemplated that the upper surface 300 and the lower surface 400 are formed by coupled spheres, such that the top of the spheres may form the upper surface 300 while the bottom portions of the sphere may form the lower surface 400, in an exemplary aspect to be discussed hereinafter.

Additionally, the sandal 100 is comprised of a strap 104 connectedly extending from the medial side 206 and the lateral side 208 over the upper surface 300. The strap 104 is contemplated as being coupled (e.g., attached, connected, joined, affixed), either permanently or temporarily, flexibly or rigidly, to one or more portions of the sandal 100. For example, the strap 104 may have a first end coupled directly to the perimeter 200 along the medial side 206. The strap 104 may also have a second end coupled directly to the perimeter 200 along the lateral side 208. Additionally, it is contemplated that the strap 104 is coupled at the first end and/or the second end to the upper surface 300, the lower surface 400, or any combination of the upper surface 300, the lower surface 400, and the perimeter 200 (e.g., the perimeter element 212).

In use, the strap 104 may provide a maintaining function that allows a wearer to maintain the sandal 100 in an as-worn position. Further, it is contemplated that the strap 104 may be formed in a common manufacturing process with the sandal 100 or in a separate manufacturing process. Additionally, it is contemplated that the strap 104 is constructed from a polymer, foam, textile, or other flexible material, which may be similar or different from a material used in constructing the sole 102.

Figure 2:
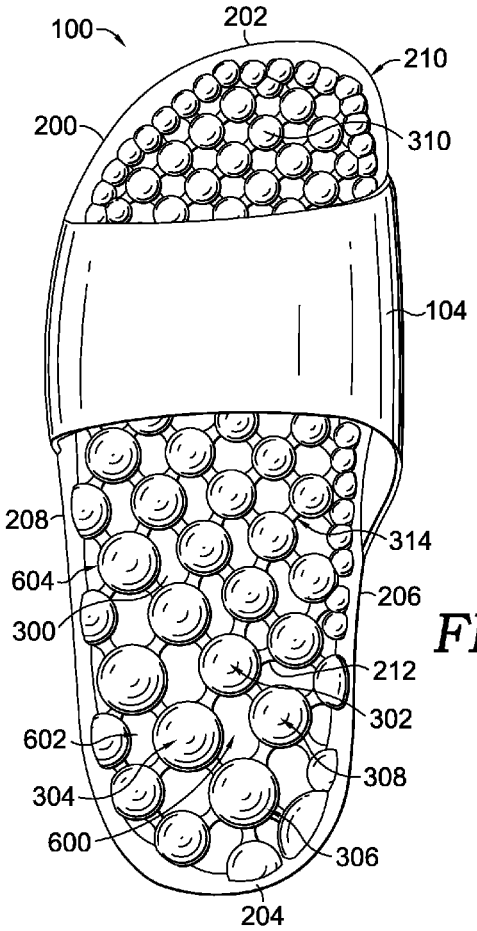
FIG. 2 depicts a top view of the exemplary sandal of FIG. 1, in accordance with an aspect of the present invention.

FIG. 2 depicts a top view of the exemplary sandal 100, in accordance with an aspect of the present invention. In particular, the upper surface 300 is depicted as being comprised of a plurality of hemispheres 302, 304, 306, 308, and 310. Additionally, the top view of the sandal 100 illustrates a plurality of voids 600, 602, and 604 that extend from the upper surface 300 through the sole 102 to the lower surface 400. The voids, in an exemplary aspect, allow for the flow of material (e.g., gas, water, sand, and the like) to pass from the upper surface 300 through the sole 102. As will be discussed hereinafter, the voids are formed, at least in part, by the perimeter element 212, the outer surfaces of one or more hemispheres, and/or joining members. Further, as will be discussed, the size, shape, spacing, and orientation of the voids, joining members, and/or upper surface 300 may vary with location to provide desired characteristics (e.g., compression, traction, resilience, flow-through, circulation).

As depicted in FIG. 2, the hemispherical objects forming the upper surface 300 may vary in size. For example, a first hemisphere 310 located proximate the toe end 202 has a diameter that is less than a second hemisphere 306 located proximate the heel end. The difference in diameter (e.g., size) of the hemispheres may provide desired compressibility resistance differentiation in the sole 102. For example, when a consistent material (e.g., foam, polymer) is used for both the hemisphere 310 and the hemisphere 306, the size of the object (e.g., sphere) may respond in a manner similar to a spring under compression, such that the larger the spring the greater the force necessary to compress the object a given percentage. Consequently, if more resistance to bottoming out (e.g., substantial compression of the sole) is desired in selected areas of a foot bed (e.g., heel region), then the increased diameter may be desired. Similarly, the smaller diameter hemisphere 310 may allow for a smaller void between it and neighboring objects. The smaller void may allow for a greater concentration of objects (e.g., spheres) in a given area, which may be effective for supporting independently moveable toes.

In an exemplary aspect, the hemispheres forming the upper surface 300 (and/or the lower surface 400) are uniform in size across the sole 102 (as will be discussed with respect to FIG. 6). Similarly, it is contemplated that the objects (e.g., hemispheres) forming the upper surface 300 and objects forming the lower surface 400 may also be uniform in size; however, a mid-band portion (to be discussed with respect to FIG. 12) that connects the upper object with the lower object may have a varied size (e.g., height extending between the upper and lower objects). Further, it is contemplated that the connecting members (e.g., portions connecting a first upper object to a second upper object) may vary in size. For example, connectors more proximate (e.g., near, in the vicinity, touching, next to, adjacent) the toe end may be smaller than connectors more proximate the heel end. In a similar contemplation, connectors may be used in one portion and totally foregone in another portion of the sole 102. Further, it is contemplated that an arrangement of neighboring objects may be adjusted based on location. For example, a linear grid-like orientation may be used in a first portion of the sole 102 and a less structured orientation may be used in a different portion of the sole 102. Additionally, it is contemplated that one or more object may form into another object at one or more locations of the sole 102. For example, a hemisphere may appear to "grow" from the perimeter element 210 such that the hemisphere is not a uniform shape where the hemisphere intersects the perimeter element 210.

Figure 5:
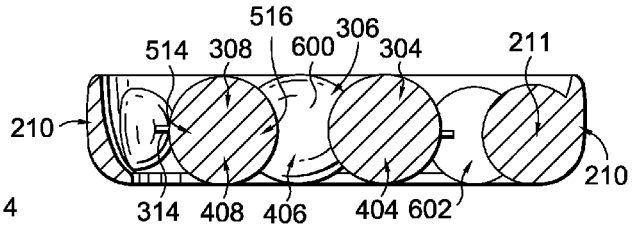
FIG. 5 depicts a cross-sectional view along the cut line 5-5 of FIG. 3, in accordance with aspects of the present invention.
Figure 3:
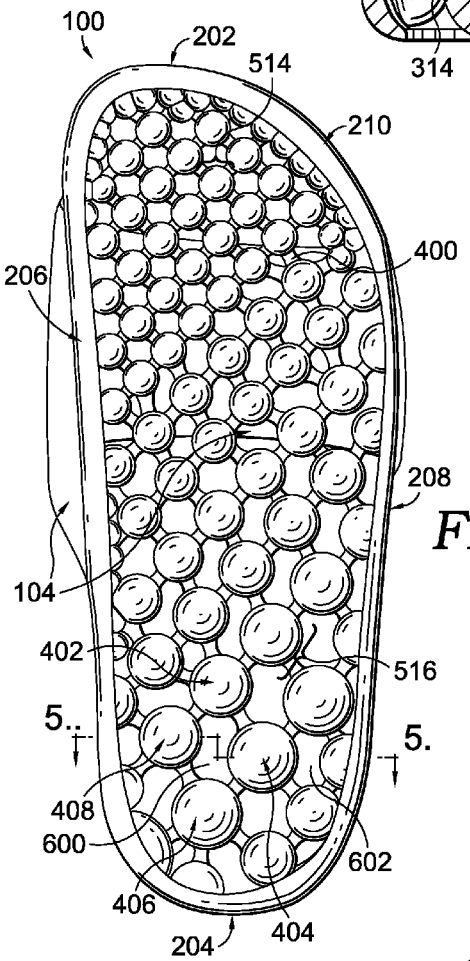
FIG. 3 depicts a bottom view of the sandal of FIG. 1, in accordance with aspects of the present invention.

FIG. 3 depicts a bottom view of the sandal 100 in accordance with aspects of the present invention. The bottom view illustrates the lower surface 400. In particular, the perimeter element 210 is illustrated, in this example, as extending into the lower surface 400 from a substantially perpendicular orientation to form a sidewall, as depicted in FIG. 5 to be discussed hereinafter.

The bottom view also illustrates, as previously discussed, variations in object size across different portions of the sole 102. For example, a hemisphere proximate the toe end is illustrated having a first diameter 514 that is smaller than a hemisphere proximate the heel end that has a second diameter 516. As a result of the differences in diameter, it is contemplated that different traction, circulation, and wearability may result. FIG. 3 also depicts a cut line 5-5 extending across a heel-end portion of the sandal 100 to provide reference for FIG. 5 hereinafter.

Additionally, FIG. 3 depicts several hemispheres forming a portion of the lower surface 400. For example, the hemispheres 402, 404, 406, and 408 are located in the heel end of the sandal 100. In an exemplary aspect, each of the hemispheres (i.e., 402-408) is mated with a respectively numbered hemisphere (i.e., 302-308) of the upper surface 300 as depicted in FIG. 2. As will be discussed with respect to FIG. 5, the upper hemispheres (e.g., 302-308), when mated with the lower hemispheres (e.g., 402-408), form sphere-like objects, in an exemplary aspect.

Figure 4:
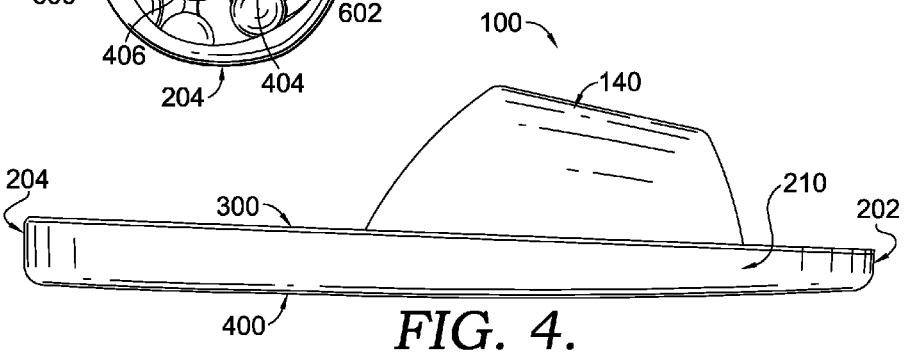
FIG. 4 depicts an exemplary side profile view of FIG. 1, in accordance with aspects of the present invention.

FIG. 4 depicts an exemplary side profile view of the sandal 100, in accordance with aspects of the present invention. In particular, the toe end 202 and the opposite heel end 204 are depicted. Additionally, the upper surface 300 and the lower surface 400 are also depicted. While FIG. 4 depicts the perimeter element 210 extending to a maximum upper surface and a maximum lower surface (e.g., at least the same height as a hemispherical object of the sole), it is contemplated that one or more of the objects (e.g., spheres, hemispheres) may extend above or below a top edge and a bottom edge respectively of the perimeter element 212. For example, it is contemplated that one or more hemispheres forming the lower surface 400 may extend downwardly past a bottom edge of the perimeter element 210. This additional extension of an object may provide additional cushioning or traction under some conditions. Similarly, it is contemplated that one or more objects of the sole 102 (e.g., hemisphere forming a portion of the upper surface 300) may extend upwardly a greater height than a top edge of the perimeter element 210. Further yet, it is contemplated that one or more objects forming the upper surface 300 may not extend as far in an upwardly direction as the top edge of the perimeter element 210 (e.g., at a portion of the perimeter element 210 proximate the object). This recessed portion of the upper surface 300 may help cradle and support a user's foot in an as-worn position.

FIG. 5 depicts a cross-sectional view along the cut line 5-5 of FIG. 3, in accordance with aspects of the present invention. In particular, cross-sectional view along cut line 5-5 is depicting a heelwardly perspective of the cross section of the sole 102. Depicted are the top hemispheres 304, 306, and 308 mated with corresponding bottom hemispheres 404, 406, and 408. As such, a medial portion of combined hemispheres 304 and 404, for example, form a sphere having a medial hemisphere 514 and a lateral hemisphere 516. Additionally, the voids 600 are depicted passing through the upper surface to the lower surface of the sole, such as a void 602. As previously discussed, a void may be defined by outer surfaces of upper hemispheres, lower hemispheres, joining members (e.g., a joining member 314), and/or the perimeter element 212.

An internal volume 213 comprises an internal volume object (e.g., hemisphere, sphere, joining member), such as a spherical-like object 211 that may be formed as part of (or appear to be merged with) the perimeter element 210. As depicted, in this example, the object 211 is formed as a cohesive portion of the perimeter element 210 (e.g., same manufacturing process, with the same material, at a concurrent time). However, it is contemplated that one or more objects may be formed of a different material, with a different manufacturing process, and/or at a different time. The object 211 also exhibits an exemplary aspect; the height of the 211 object does not extend to the same extent upwardly as a corresponding height of the perimeter element 212. As a result of the discrepancy in upwardly extension, a natural cradle for maintaining a user's foot may be formed, which prevents lateral (or any direction in the X or Y plane) movement of the foot when in an as-worn position relative to the sandal 100. Additionally, the lower surface formed by at least the hemispheres 408, 406, and 404 extend in a downwardly direction to a common plane as the perimeter element 212. However, as previously discussed, it is contemplated that one or more objects may extend above or below one or more portions of the perimeter element 210.

Figure 6:
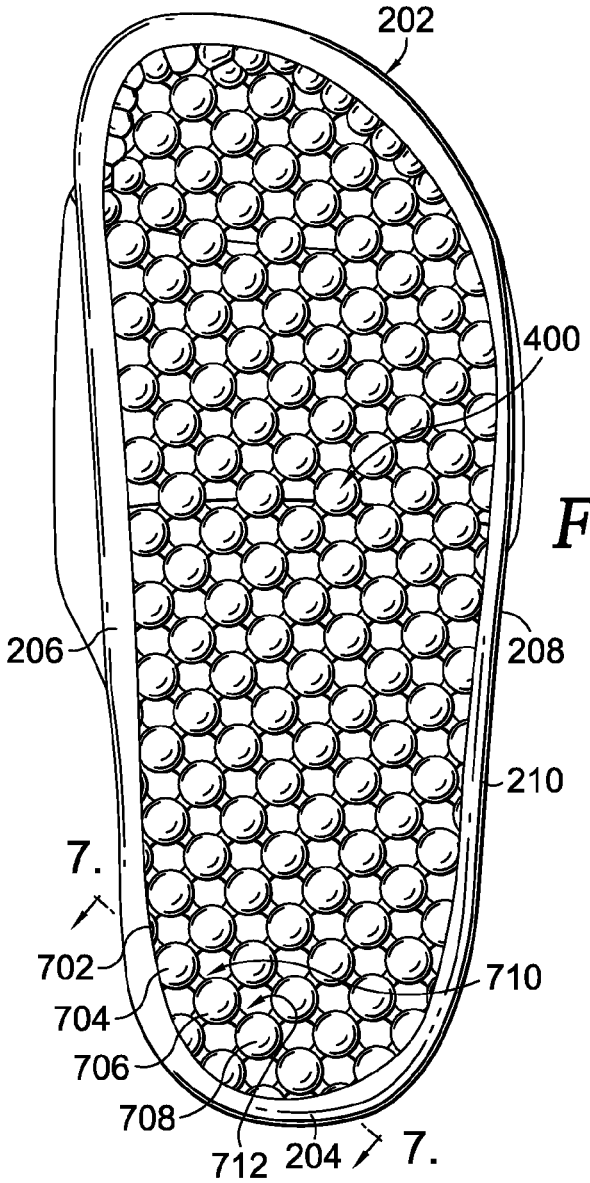
FIG. 6 depicts a bottom perspective of an additional exemplary sandal, in accordance with aspects of the present invention.

FIG. 6 depicts a bottom perspective of an additional exemplary sandal, in accordance with aspects of the present invention. In particular, the objects, in this case spheres, forming the internal volume of the sole are of a uniform size and shape, generally. However, some of the objects more proximate a perimeter element may merge into the perimeter element and therefore have a different size or shape.

Figure 7:
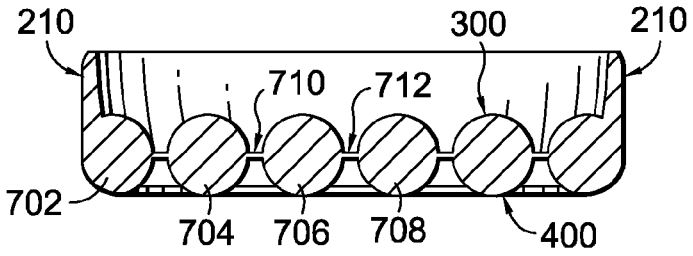
FIG. 7 depicts a heelwardly-oriented cross-sectional view of the sandal illustrated in FIG. 6 along cut line 7-7, in accordance with aspects of the present invention.

The objects forming the upper surface and the lower surface 400 are comprised of spheres 702, 704,706, and 708, as also depicted in FIG. 7. Sphere 706 is coupled by a joining member 710 with the sphere 704. Similarly, the sphere 706 is also coupled with the sphere 708 by way of a joining member 720. In this example, the joining member is a ribbon-like member that is integrally formed with the spheres. However, it is contemplated that a joining member may be of any shape, size, and/or orientation relative to one or more objects (e.g., cylinder-like). Further, it is contemplated that the joining member may be coupled to a perimeter element or other joining members. Additionally, it is contemplated that various sizes, shapes, and other characteristics (e.g., material, coupling means) may be implemented in any combination. The joining members may provide additional flexibility to the sandal. Further, the joining member may provide additional void creation ability while maintaining spherical sizing.

The FIG. 6 depicts a cut line 7-7 passing through the spheres 702-708, which provides the perspective depicted in FIG. 7. FIG. 7 depicts a heelwardly oriented cross-sectional perspective of the sandal illustrated in FIG. 6 along cut line 7-7, in accordance with aspects of the present invention. In particular, the spheres 702-708 are depicted as forming the upper surface 300 and the lower surface 400. As depicted the upper surface 300 is formed from hemispheres mated with corresponding hemispheres forming the lower surface 400, which results in the spheres 702-708. Additionally, the joining members 710 and 712 are depicted as having a uniform thickness along their length between coupled spheres. However, it is contemplated that varied size, shape, and other geometric characteristics may be implemented with one or more joining members. Further, while the joining members are depicted as coupling with the spheres at a vertical tangential point (e.g., 9 o'clock and 3 o'clock positions), it is contemplated that a joining member may be coupled with an object at any point and at any orientation relative to an object (e.g., sphere).

While the spheres 702-208 are depicted as being constructed from a common and a uniform material, it is contemplated that multiple materials (non-uniform) may be used. For example a first portion of a first sphere may be constructed from a first material (e.g., bottom surface may be formed from a durable rubber) and a second portion of the first sphere may be constructed from a second material (e.g., upper surface may be formed from a cushioning foam-like material). Similarly, it is contemplated that a non-uniform density common material may be used (e.g., higher density of material near the ground-contacting surface and a lower density of the material near a foot-contacting service). Additionally, it is contemplated that multiple materials may be used to provide other functional characteristics (e.g., rubber core materials to which a foam material is formed around to form the sole).

Figure 8:
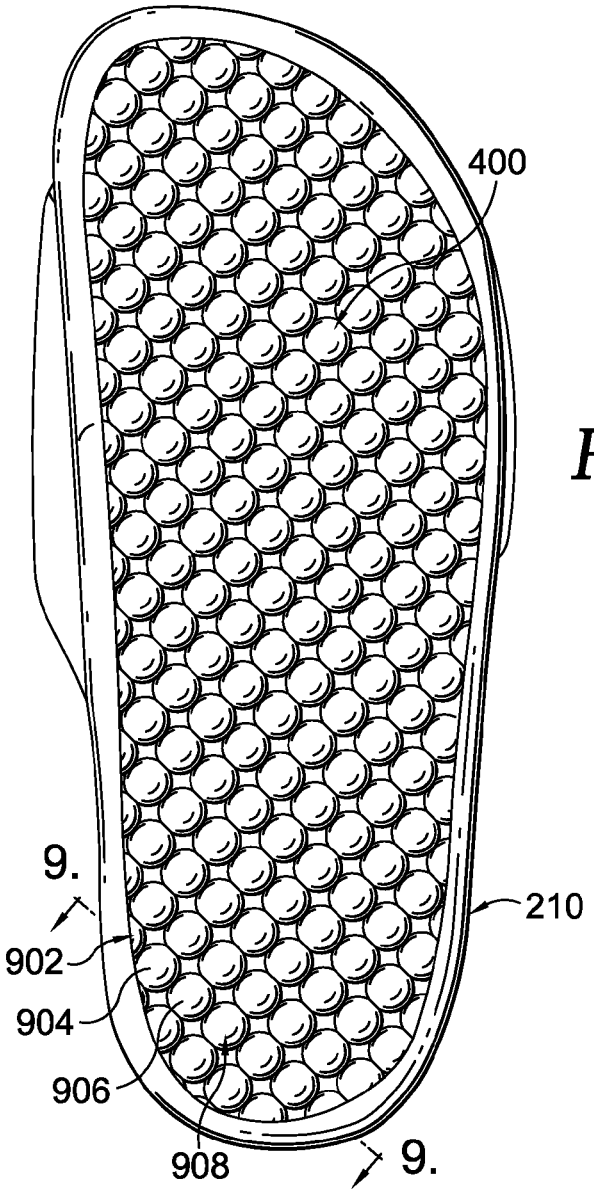
FIG. 8 depicts a bottom perspective of an additional exemplary sandal, in accordance with aspects of the present invention.
Figure 9:
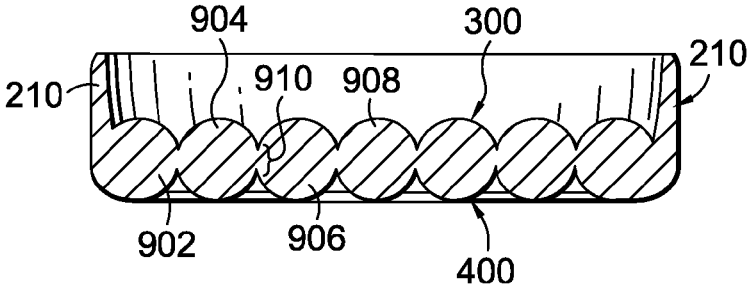
FIG. 9 depicts a heelwardly-oriented cross-sectional view of the sandal illustrated in FIG. 8 along cut line 9-9, in accordance with aspects of the present invention.

FIG. 8 depicts a bottom perspective of an additional exemplary sandal, in accordance with aspects of the present invention. The objects of the sandal depicted in FIG. 9 are directly coupled with one another without the use of joining members. For example, spheres 902-908 are depicted as having a cut line 9-9 passing through to be depicted in FIG. 9, which is discussed hereinafter.

In this example, the internal volume object is directly coupled to other internal volume objects of similar shape and size. However, as will be discussed hereinafter, it is contemplated that a joining member may also be an internal object, just of a different size (see FIG. 10 discussed hereinafter). Foregoing use of joining members in one or more portions of the sandal may allow for a higher concentration of the internal object, smaller voids, and a greater surface area of contact with a foot and the ground, and a greater sense of uniformity to a wearer's foot.

FIG. 9 depicts a cross-sectional view along the cut line 9-9 of FIG. 8, in accordance with aspects of the present invention. As previously discussed, the spheres 902-908 are directly coupled to a corresponding object, such as another sphere. An amount of intersection forming a coupled region 910 between the objects may vary. For example, depending on a desired resulting void, discrepancy between height of the upper surface and the coupled region (e.g., the larger the coupled region the smaller the discrepancy in height), and other factors may be considered.

Figure 10:
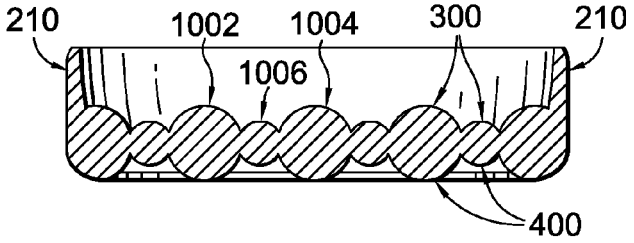
FIG. 10 depicts a cross-sectional view of an exemplary sandal having spherical-like objects in lieu of ribbon-like joining members, in accordance with aspects of the present invention.

FIG. 10 depicts a cross-sectional view of an exemplary sandal having spherical-like objects in lieu of ribbon-like joining members, in accordance with aspects of the present invention. For example, a sphere 1002 is coupled with a sphere 1004 by way of a smaller sphere 1006. The spheres 1002 and 1004 form a portion of the upper surface along with the sphere 1006. Similarly, the spheres 1002-1006 form a portion of the lower surface 400. While the sphere 1006 is depicted as a spherical object, it is contemplated that any object shape, size, and orientation may be used at any location to facilitate the coupling of the other objects forming the sole. Objects, such as spheres, that are tangentially connected are those objects that are coupled directly or indirectly (e.g., by way of a joining member) at a mid-band portion of the object. Therefore, an object is tangentially coupled when it is coupled to another object proximate the mid-band portion.

Figure 11:
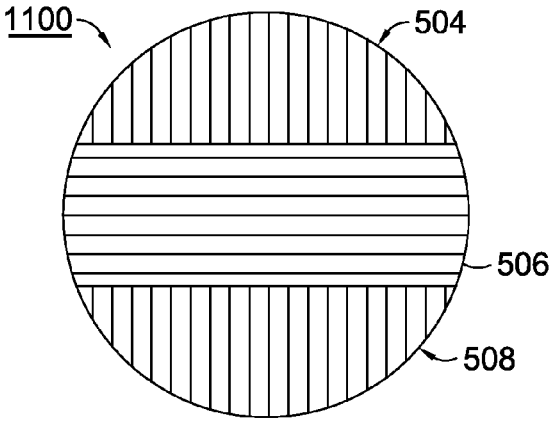
FIG. 11 depicts a cross-sectional view of an exemplary object forming a portion of a sole in a sandal, in accordance with aspects for the present invention.

FIG. 11 depicts a cross-sectional view of an exemplary object 1100 forming a portion of a sole in a sandal, in accordance with aspects for the present invention. The object 1100 is spherical in shape having an upper portion 504, a mid-band portion 506, and a lower portion 508. As depicted, the upper portion 504 and the lower portion 508 form a hemispherical surface in the upper and lower surfaces respectively. However, as discussed previously, it is contemplated that either portion may actually form any type of surface having any type of profile (e.g., flat and circular, indented and oval, angled and polygonical, and/or any combination). In an exemplary aspect, a joining member (and/or another object) is coupled with the object 1100 proximate the mid-band portion 506; however, it is also contemplated that a joining member (and/or another object) is coupled proximate the upper portion 504 and/or the lower portion 508.

Figure 12:
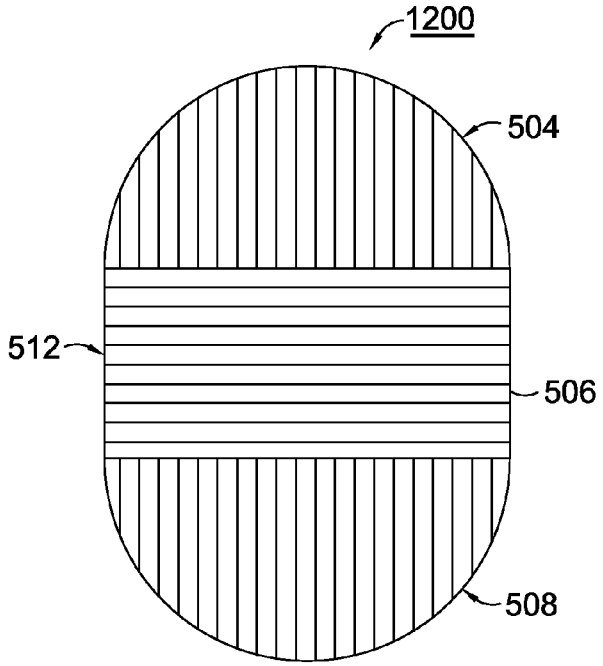
FIG. 12 depicts a cross-sectional view of another object forming a portion of a sole in a sandal, in accordance with aspects for the present invention.

FIG. 12 depicts a cross-sectional view of another exemplary object 1200 forming a portion of a sole in a sandal, in accordance with aspects for the present invention. The object 1200 is comprised of the upper portion 504, the mid-band portion 506, and a lower portion 508. However, the mid-band portion 506 is a cylinder-like shaped portion 512. A height of the cylinder-like shaped portion 512 extending between the upper portion 504 and the lower portion 508 may be adjusted to provide variations in overall height of the object 1200. While the upper portion 504 and the lower portion 508, if mated directly together, form a complete sphere, it is contemplated that less than a complete hemisphere forms either the upper portion 504 or the lower portion 508 in an exemplary aspect.

Although the sandal construction is described above by referring to particular embodiments, it should be understood that the modifications and variations could be made to the sandal construction described without departing from the intended scope of protection provided by the following claims.

The invention claimed is:

1. A sandal comprising:

a sole having an upper surface, an opposite lower surface, and a perimeter defined by a toe end, an opposite heel end, a medial side, and an opposite lateral side;

(1) the upper surface comprising a first plurality of hemispheres, each of the first plurality of hemispheres having a curved surface forming at least a portion of the upper surface and serving as a foot contact area for a foot when in an as-worn position;

(2) the lower surface comprising a second plurality of hemispheres, each of the second plurality of hemispheres having a curved surface forming at least a portion of the lower surface and serving as a ground contact area when in an as-worn position, wherein the first plurality of hemispheres correspond with the second plurality of hemispheres to form a plurality of spheres, wherein each sphere in the plurality of spheres is comprised of a lateral hemisphere an opposite medial hemisphere, an upper hemisphere, and an opposite lower hemisphere, wherein the plurality of spheres extend from the upper surface to the lower surface; and (3) a plurality of voids extending through the sole, wherein the plurality of voids are defined by an upper portion, a mid-band portion, and a lower portion of an outer surface of the plurality of spheres, and wherein the plurality of voids are configured to allow flow of material through the upper surface and the lower surface through the sole.

2. The sandal of claim 1, wherein the plurality of spheres are uniform in diameter.

3. The sandal of claim 1, wherein the plurality of spheres are comprised of at least two spheres having different diameters.

4. The sandal of claim 1, wherein the plurality of spheres are comprised of spheres having a smaller diameter proximate the toe end than spheres proximate the heel end.

5. The sandal of claim 1, wherein the medial hemisphere is directly coupled with the lateral hemisphere.

6. The sandal of claim 1, wherein a first outer surface of a first medial hemisphere of a first sphere in the plurality of spheres, is coupled to a second outer surface of a second lateral hemisphere of a second sphere in the plurality of spheres by a third outer surface of a joining sphere, the joining sphere having a diameter less than the first sphere and the second sphere.

7. The sandal of claim 1, wherein a first outer surface of a first medial hemisphere of a first sphere is coupled to a second outer surface of a lateral hemisphere of a second sphere, by a joining member extending from the first outer surface of the first medial hemisphere to the second outer surface of the second lateral hemisphere.

8. The sandal of claim 1, wherein a first outer surface of a first medial hemisphere and a second outer surface of a second lateral hemisphere are joined with a cylinder extending between the first outer surface of the first medial hemisphere and the second outer surface of the second lateral hemisphere.

9. A sandal comprising:

(1) a sole having a toe end and an opposite heel end and having opposite medial and lateral sides, and a first plurality of spheres, wherein an outer surface of each sphere is coupled to at least one other outer surface of another sphere of the first plurality of spheres, wherein the first plurality of spheres extend between the toe end and the heel end, and medial and lateral sides, the sole further comprising;

(2) a perimeter element extending around a perimeter of the sole forming an interior volume, wherein the perimeter element comprises a plurality of tangentially coupled outer surfaces corresponding to a second plurality of spheres, wherein the second plurality of spheres form an upper surface and a lower surface of the sole within the interior volume, wherein the upper surface is a surface substantially occupied by a bottom of a foot when in an in-worn position and the lower surface is a surface substantially serving as a traction surface for the sole; and (3) a plurality of voids, wherein the plurality of voids are defined, in part, by an upper portion, a mid-band portion, and a lower portion of the plurality of tangentially coupled outer surfaces corresponding to the second plurality of spheres, wherein the plurality of voids are configured to allow flow of material through the upper surface and the bottom surface of the sole, and wherein the plurality of voids are located within the interior volume.

10. The sandal of claim 9, wherein the perimeter element has a height greater than a diameter of a first sphere of the second plurality of spheres, the perimeter element is functional to inhibit movement of a foot off of the sole when in an as-worn position.

11. The sandal of claim 9, wherein the second plurality of spheres and the perimeter element are formed from a common molding operation.

12. The sandal of claim 9, wherein each of the second plurality of spheres are connected to at least another of the second plurality of spheres.

13. The sandal of claim 9, wherein at least two spheres of the plurality of tangentially coupled outer surfaces corresponding to the first plurality of spheres are coupled by a joining member.

14. The sandal of claim 9, wherein a size of a sphere proximate the heel end of the first plurality of coupled spheres is larger than a size of a sphere proximate the toe end of the first plurality of coupled spheres.

15. The sandal of claim 9, wherein a greater concentration of the first plurality of spheres occurs in a first portion of the internal volume than in a second portion of the internal volume.

16. A sandal comprising:

a molded sole having an upper surface and a lower surface, a toe end and an opposite heel end, and having opposite medial and lateral sides extending between the toe end and the heel end, a sole comprising a plurality of spheres arranged to form the upper surface and the lower surface of the sole;

each sphere in the plurality of the plurality of spheres is comprised of an outer surface defined by:

(1) an upper portion forming an upper surface, rounded foot contact area, wherein the rounded foot contact area provides a foot bed useable by a foot when in an as-worn position;

(2) a lower portion forming a lower surface, rounded traction area, wherein the rounded traction area provides traction for the sandal when in the as-worn position;

(3) a mid-band portion extending between the upper portion and the lower portion, the mid-band portion providing a location of coupling between one or more outer surfaces corresponding to one or more spheres of the plurality of spheres;

the sole also including a plurality of voids, each void of the plurality of voids creating an opening through the sole that extends through the upper portion, the mid-band portion, and the lower portion of the outer surface of the plurality of spheres, wherein each void in the plurality of voids is defined by an outer surface of at least one sphere in the plurality of spheres; and the plurality of spheres comprising a first sphere having a first diameter and a second sphere having a second diameter, wherein the first diameter is less than the second diameter, and further wherein the first sphere is positioned proximate the toe end and the second sphere is positioned proximate the heel end.

* * * * *